US010406834B2

(12) United States Patent
Fujii et al.

(10) Patent No.: US 10,406,834 B2
(45) Date of Patent: Sep. 10, 2019

(54) SHEET PROCESSING DEVICE, SHEET MANUFACTURING APPARATUS, AND SHEET PROCESSING METHOD

(71) Applicant: SEIKO EPSON CORPORATION, Tokyo (JP)

(72) Inventors: Tatsuya Fujii, Suwa (JP); Takumi Sago, Matsumoto (JP); Tsukasa Ota, Kofu (JP); Satomi Yoshioka, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/145,979

(22) Filed: Sep. 28, 2018

(65) Prior Publication Data

US 2019/0100040 A1 Apr. 4, 2019

(30) Foreign Application Priority Data

Sep. 29, 2017 (JP) ..... 2017-191455

(51) Int. Cl.

| | |
|---|---|
| ***B41M 7/00*** | (2006.01) |
| ***B41J 11/60*** | (2006.01) |
| ***B41J 29/26*** | (2006.01) |

(52) U.S. Cl.

CPC ..... *B41J 11/60* (2013.01); *B41J 29/26* (2013.01); *B41M 7/0009* (2013.01)

(58) Field of Classification Search

CPC ..... B41J 11/60; B41J 29/26; B41M 7/0009; D21C 5/025; D21C 5/027

See application file for complete search history.

(56) References Cited

U.S. PATENT DOCUMENTS

| | | | | | |
|---|---|---|---|---|---|
| 5,545,381 | A | * | 8/1996 | Iida | B41J 29/26 209/576 |
| 5,605,777 | A | * | 2/1997 | Ando | B41M 7/0009 399/343 |
| 5,769,957 | A | * | 6/1998 | Murakami | B41J 2/315 134/15 |

FOREIGN PATENT DOCUMENTS

| | | | | | |
|---|---|---|---|---|---|
| CN | 103351702 | A | | 10/2013 | |
| CN | 106201367 | A | | 12/2016 | |
| JP | H05-011664 | A | | 1/1993 | |
| JP | H08-226087 | A | | 9/1996 | |
| JP | 2001-279589 | A | | 10/2001 | |
| JP | 3313319 | | * | 8/2002 | B41M 5/00 |
| JP | 2010-1408 | A | | 1/2010 | |
| TW | 200706618 | A | | 2/2007 | |

* cited by examiner

*Primary Examiner* — Huan H Tran
(74) *Attorney, Agent, or Firm* — Oliff PLC

(57) ABSTRACT

A sheet processing device, a sheet manufacturing apparatus, and a sheet processing method enable effectively removing the color material of printed parts. A sheet processing device for processing a printed sheets has a detector configured to detect the printed parts of the sheet; and a refining prevention agent applicator configured to selectively apply a refining prevention agent that prevents refinement of the sheet to a printed area including the printed parts detected by the detector.

12 Claims, 9 Drawing Sheets

SHEET PROCESSING DEVICE, SHEET MANUFACTURING APPARATUS, AND SHEET PROCESSING METHOD

BACKGROUND

1. Technical Field

The present invention relates to a sheet processing device, a sheet manufacturing apparatus, and a sheet processing method.

2. Related Art

With increased concern about the environment, interest in both reducing consumption of paper and recycling paper has grown. See, for example, JP-A-H5-11664.

JP-A-H5-11664 describes a paper erasing machine having a charger for charging used paper, and a developer that uses differences in the charge characteristics of the toner or ink on the paper and the paper itself to coat the parts holding toner or ink (the printed parts) with toner or ink of the same color as the background. For example, if the background color of the used paper, that is, the color of the paper, is white, white toner is applied to the printed parts containing toner or ink, and the paper is then used as recycled paper.

However, the technology described in JP-A-H5-11664 does not remove the toner or ink from the used paper. In addition, even when toner or ink of the background color is applied to the area with the toner or ink to be erased, shapes of the coated toner or ink may still be slightly visible in some cases.

SUMMARY

One object of the present invention is to provide a sheet processing device, a sheet manufacturing apparatus, and a sheet processing method that can effectively remove color material from the printed portion of used paper.

The present invention is directed to solving at least part of the foregoing problem, and may be embodied as described below.

A sheet processing device according to one aspect of the invention is a sheet processing device that processes printed sheets, and has: a detector configured to detect any printed parts of the sheet; and a refining prevention agent applicator configured to selectively apply a refining prevention agent that prevents refinement of the sheet to a printed area including the printed part detected by the detector.

This configuration can prevent over-refinement of fiber and color material (such as ink or toner) in the printed areas of sheets containing fiber. As a result, when the sheet is defibrated, the printed area becomes unrefined waste material, and the unprinted area outside the printed area becomes refined material. Refined material can therefore be more effectively separated from the unrefined waste material. As a result, color material CM in the printed parts can be effectively removed, and the whiteness of the manufactured sheets can be improved.

A sheet processing device according to another aspect of the invention also has a conveyance unit configured to convey the sheet, and the sheet processing device executes at least one of detecting the printed part of the sheet conveyed by the conveyance device, and applying the refining prevention agent to the printed area of the sheet conveyed by the conveyance device.

This configuration enables applying the refining prevention agent while the sheet is being conveyed. More specifically, pausing conveyance to detect the printed parts, and pausing conveyance to apply refining prevention agent to the printed areas, can be prevented. As a result, a drop in processing efficiency (productivity) can be prevented.

In a sheet processing device according to another aspect of the invention, the refining prevention agent applicator ejects a liquid containing the refining prevention agent to the printed area.

This configuration facilitates penetration of the refining prevention agent between the fibers in the sheet, and more reliably achieves the effects described above.

Preferably in a sheet processing device according to another aspect of the invention, the refining prevention agent is hydrophilic.

This configuration improves binding between the refining prevention agent and fiber when the sheet contains cellulosic fiber, for example, and as a result more reliably achieves the effects described above.

A sheet processing device according to another aspect of the invention preferably also has a refining device configured to refine the sheet after the refining prevention agent is applied to the printed part, and refinement of the printed area by the refining device is suppressed by the refining prevention agent compared with refinement of areas outside the printed area.

This configuration enables forming refined material and unrefined waste material in the refining device.

A sheet processing device according to another aspect of the invention preferably also has a classifier configured to classify refined material acquired by the refining device.

This configuration can isolate the refined material from the unrefined waste material.

A sheet processing device according to another aspect of the invention preferably also has a controller configured to control operation of the refining prevention agent applicator based on information detected by the detector.

This configuration enables selectively applying an refining prevention agent that prevents refining the sheet to the printed areas containing the printed parts detected by the detector.

Preferably in a sheet processing device according to another aspect of the invention, the detector has an imaging device configured to image the sheet; and the controller has a data processor configured to process image data acquired by the imaging device.

This configuration enables processing (identifying the printed parts and setting the printed area) the captured image data.

A sheet manufacturing apparatus according to another aspect of the invention includes the sheet processing device according to the invention.

This aspect of the invention enables manufacturing (recycling) sheets while utilizing the benefits of the sheet processing device of the invention.

A sheet processing method according to another aspect of the invention is a sheet processing method for processing sheets supplied as feedstock for making recycled sheets, and includes: a detection process of detecting printed parts of the sheets; and a refining prevention agent application process of selectively applying a refining prevention agent to a printed area including the printed part detected by the detection process to prevent refining that part of the sheet.

This configuration can prevent over-refinement of fiber and color material (such as ink or toner) in the printed areas of sheets containing fiber. As a result, when the sheet is defibrated, the printed area becomes unrefined waste material, and the unprinted area outside the printed area becomes refined material. Refined material can therefore be more effectively separated from the unrefined waste material. As a result, color material CM in the printed parts can be effectively removed, and the whiteness of the manufactured sheets can be improved.

A sheet processing method according to another aspect of the invention preferably also includes: a refining process of refining the sheet after the refining prevention agent application process, refinement of the printed area by the refining process being suppressed compared with refining areas outside the printed area.

This configuration enables forming refined material and unrefined waste material.

A sheet processing method according to another aspect of the invention preferably also includes: a classifying process that executes after the after the refining process and classifies refined material acquired by the refining process.

This configuration can separate the refined material from the unrefined waste material.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a sheet processing device, a sheet manufacturing apparatus, and a sheet processing method according to the invention are described below with reference to the accompanying figures.

Embodiment 1

Figure 1:
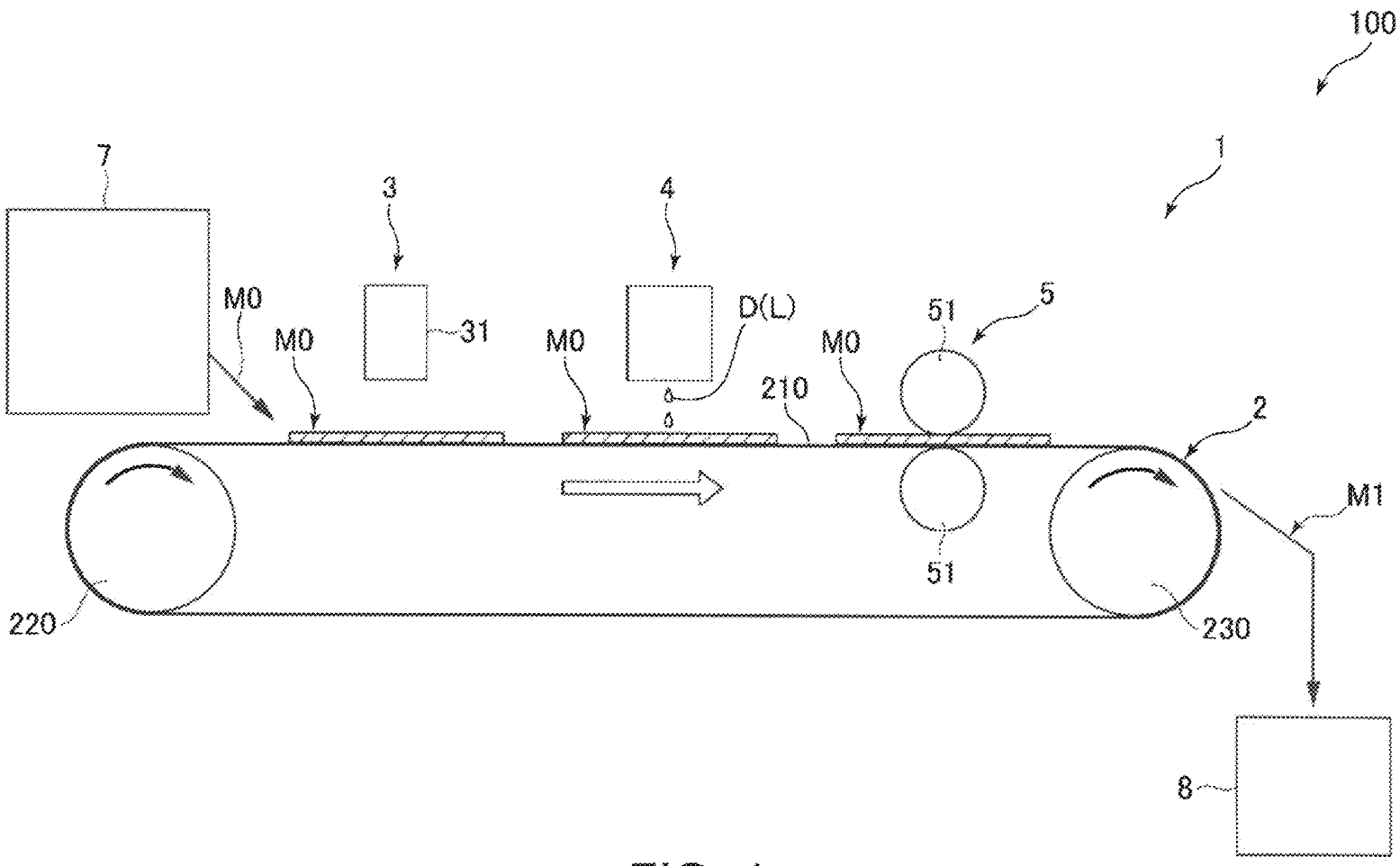
FIG. 1 is a schematic side view illustrating the configuration of a sheet processing device according to the invention disposed to the upstream side of a sheet manufacturing apparatus according to a first embodiment of the invention.
Figure 2:
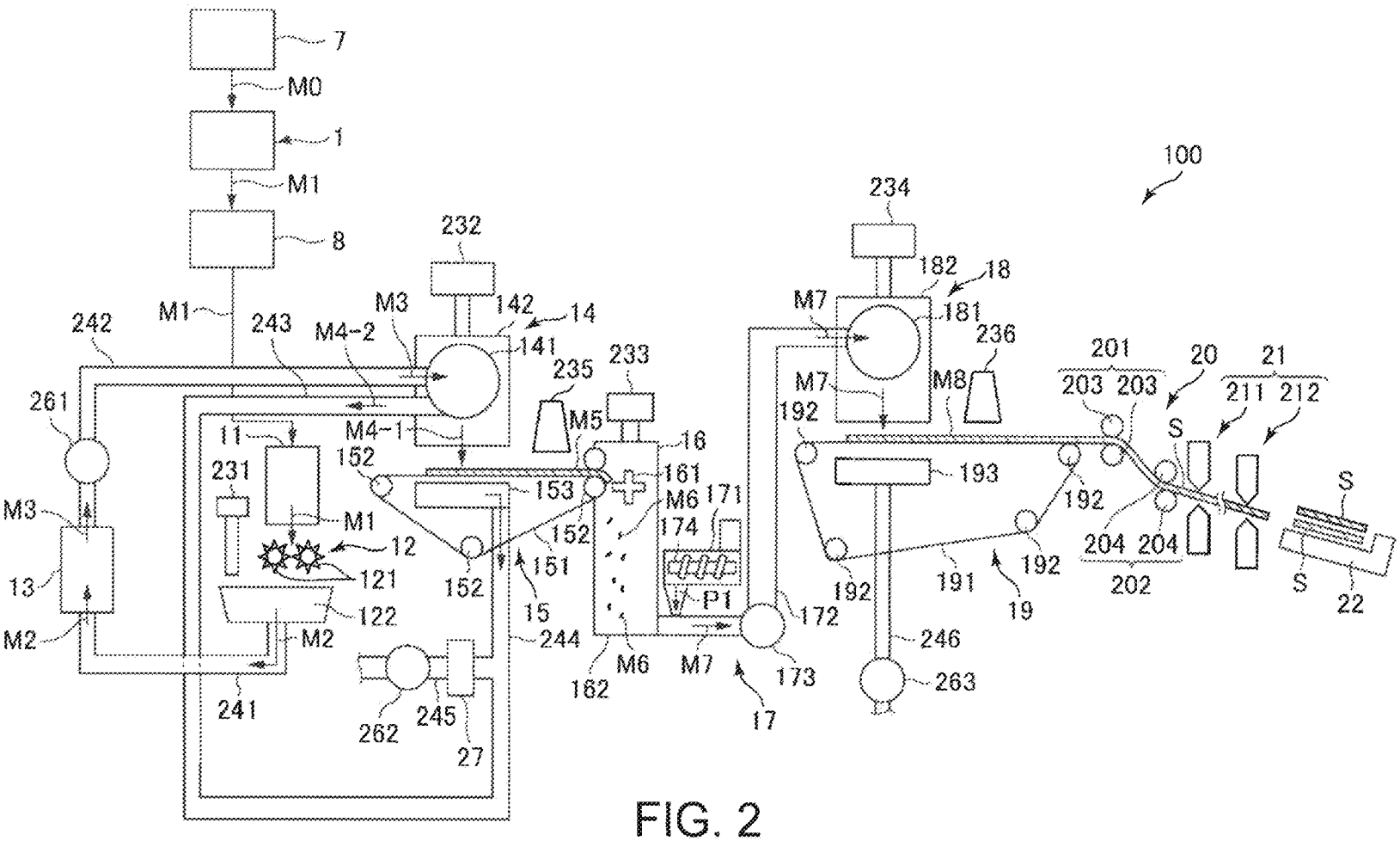
FIG. 2 is a schematic side view illustrating the configuration of the downstream side of a sheet manufacturing apparatus according to a first embodiment of the invention.
Figure 3:
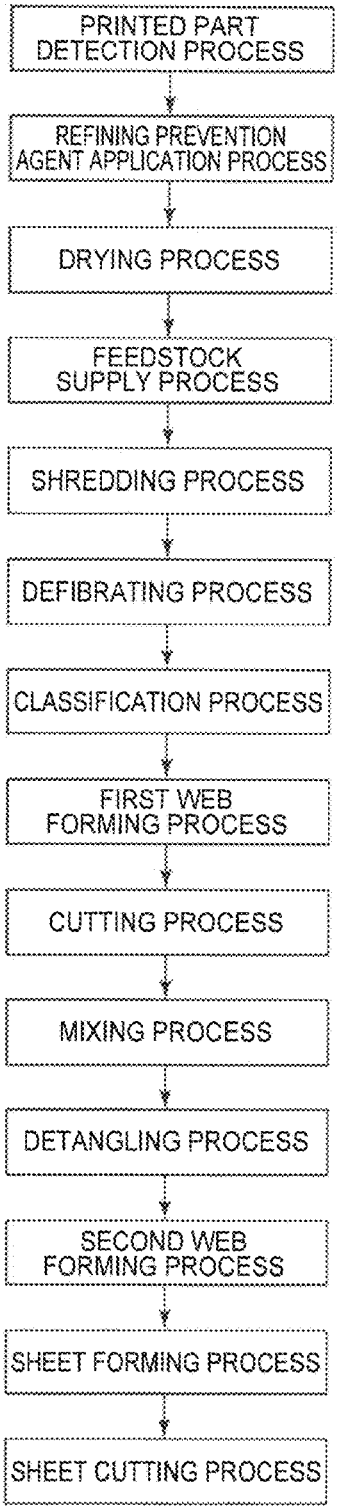
FIG. 3 is a flow chart illustrating processes executed by a sheet manufacturing apparatus according to the first embodiment of the invention.
Figure 4:
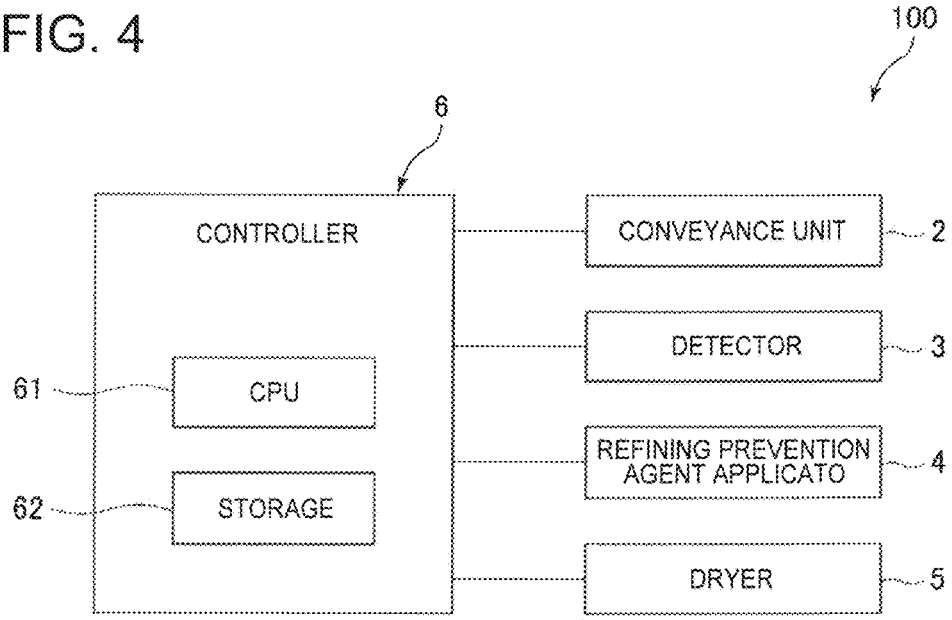
FIG. 4 is a block diagram of the sheet processing device shown in FIG. 1.
Figure 5:
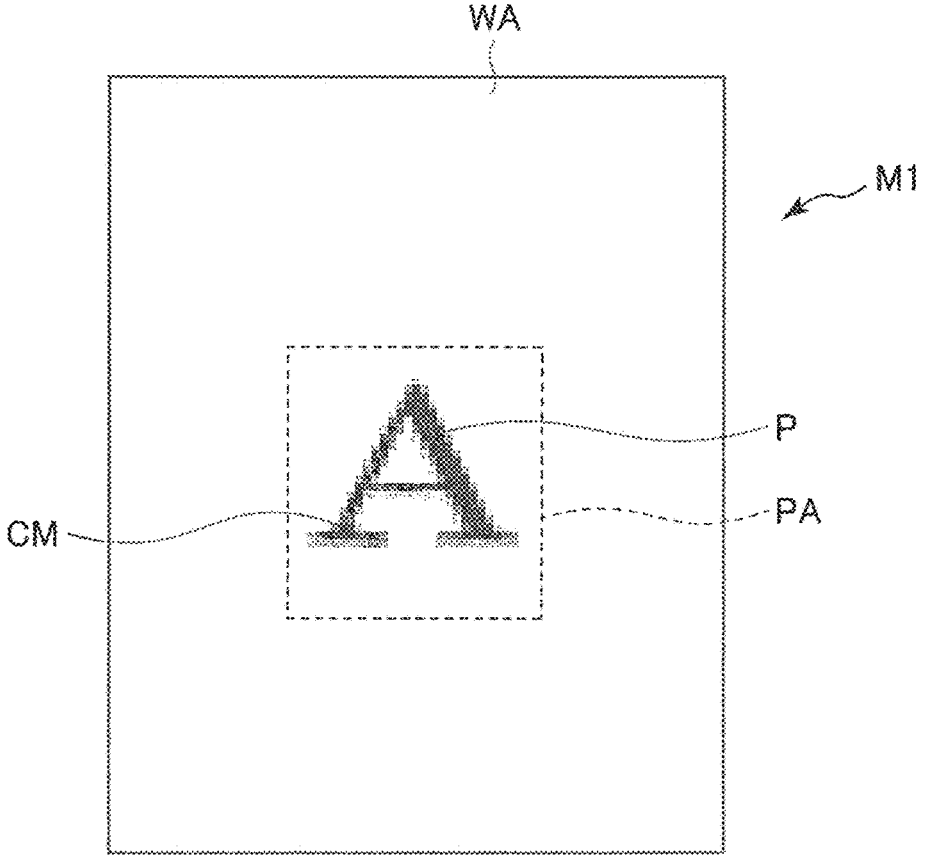
FIG. 5 is a plan view of feedstock (a printed sheet) supplied to the sheet processing device shown in FIG. 1.
Figure 6:
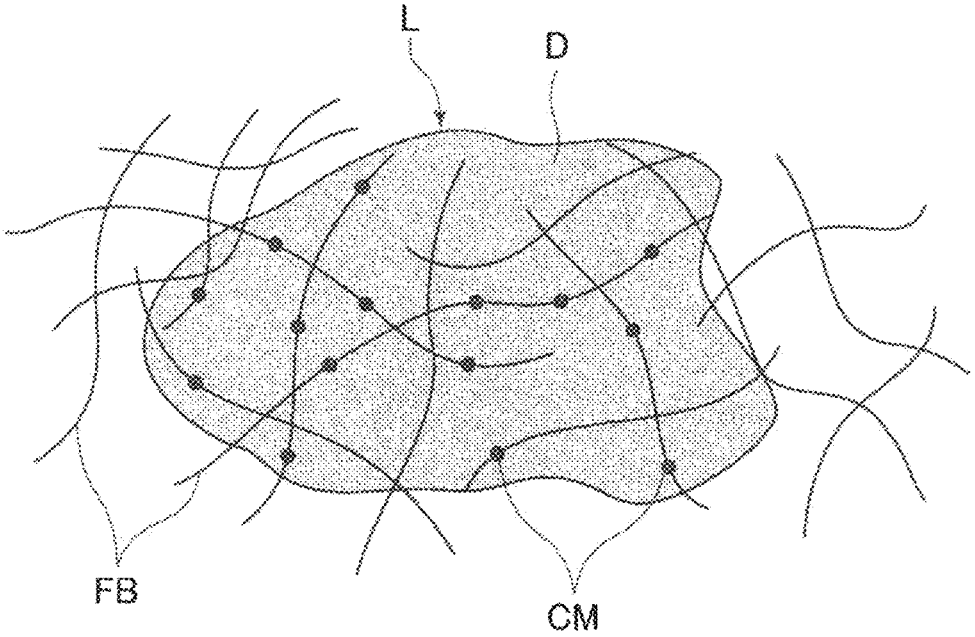
FIG. 6 is an enlarged view illustrating fiber and color material in the printed part, and illustrates when a refining prevention agent has been applied to fiber and color material.
Figure 7:
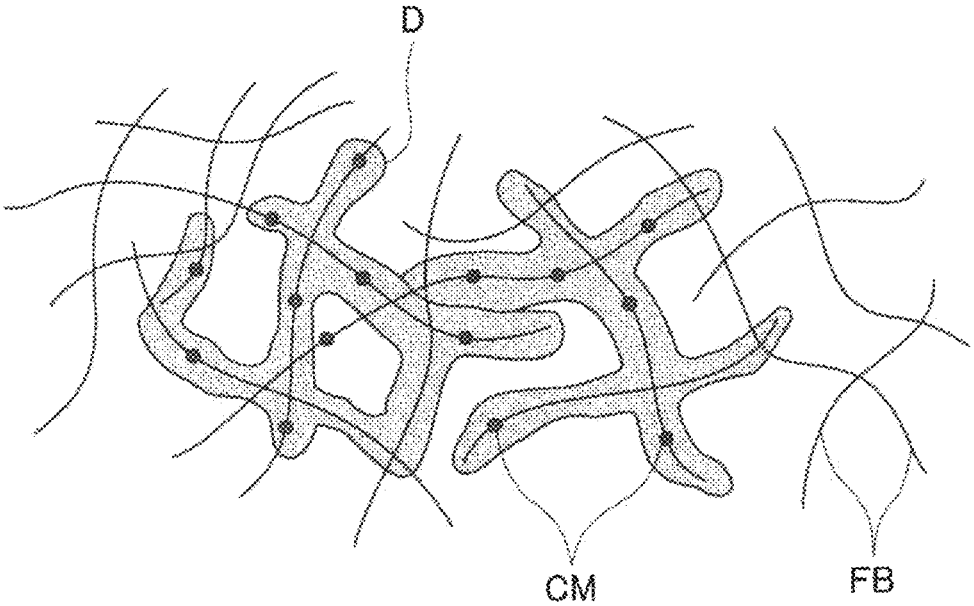
FIG. 7 is an enlarged view illustrating the fiber and color material in the printed part shown in FIG. 6 after passing through a dryer.
Figure 8:
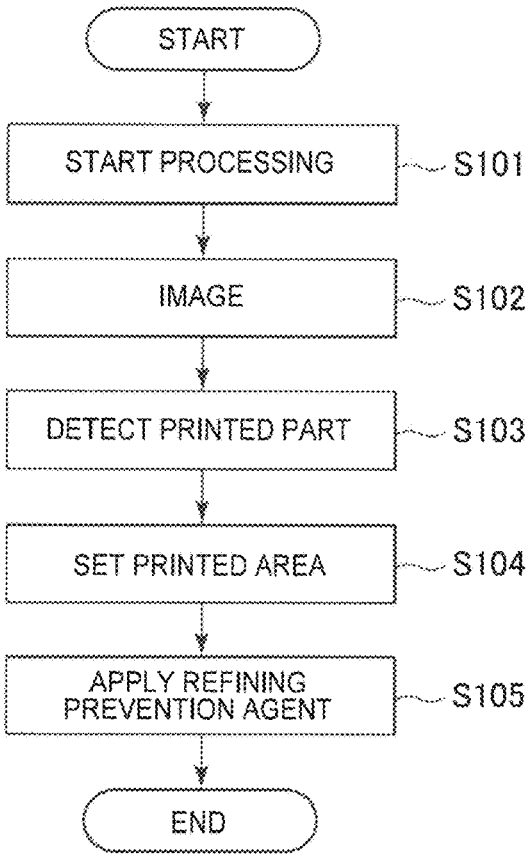
FIG. 8 is a flow chart describing the control operation of the controller shown in FIG. 4.

FIG. 1 is a schematic side view illustrating the configuration of a sheet processing device according to the invention disposed to the upstream side of a sheet manufacturing apparatus according to a first embodiment of the invention. FIG. 2 is a schematic side view illustrating the configuration of the downstream side of a sheet manufacturing apparatus according to a first embodiment of the invention. FIG. 3 is a flow chart illustrating processes executed by a sheet manufacturing apparatus according to the first embodiment of the invention. FIG. 4 is a block diagram of the sheet processing apparatus shown in FIG. 1. FIG. 5 is a plan view of feedstock (a printed sheet) supplied to the sheet processing apparatus shown in FIG. 1. FIG. 6 is an enlarged view illustrating fiber and color material in the printed part, and illustrates when a refining prevention agent has been applied to fiber and color material. FIG. 7 is an enlarged view illustrating the fiber and color material in the printed part shown in FIG. 6 after passing through a dryer. FIG. 8 is a flow chart describing the control operation of the controller shown in FIG. 4.

Note that for convenience below, the top as seen in FIG. 1 is referred to as the top or above, the bottom as the bottom or below; the left side as the left or upstream side, and the right as the right or downstream side.

The sheet processing device 1 shown in FIG. 1 is a sheet processing device that processes feedstock M0 (sheets) supplied as the feedstock (material) for sheet recycling, and has a detector 3 and a refining prevention agent applicator 4.

The detector 3 detects the printed part P where the feedstock M0 (sheet) was printed on.

The refining prevention agent applicator 4 (refining suppressant applicator) selectively applies a refining prevention agent D (refining suppressant) that prevents (suppresses) refining the feedstock M0 (sheet) to the printed area PA including the printed part P detected by the detector 3.

As a result, if the feedstock M0 contains fiber FB, over-refinement of the fiber FB and color material CM (such as ink and toner) in the printed area PA can be prevented. Therefore, when the feedstock M0 is refined, the printed area PA becomes unrefined material, and the unprinted area, referred to below as the white area WA, outside the printed area PA becomes the refined material. The refined material and undefibrated material can therefore be more effectively separated. As a result, color material CM in the printed part P can be effectively removed, and the whiteness of the resulting sheet S can be improved.

The sheet manufacturing apparatus 100 shown in FIG. 1 includes the sheet processing device 1 described above.

The invention thus comprised can therefore receive the benefits of the above sheet processing device 1 when manufacturing (recycle) sheets S.

A sheet processing method according to the invention is a method of processing feedstock M0 (sheet) that is the material for sheet recycling, and includes printed area detection step of detecting the printed part P that was printed on the feedstock M0 (sheet), and a refining prevention agent application step of selectively applying a refining prevention agent D that prevents refining the feedstock M0 (sheet) to the printed area PA including the printed part P detected in the printed area detection step.

As a result, if the feedstock M0 contains fiber FB, over-refinement of the fiber FB and color material CM (such as ink and toner) in the printed area PA can be prevented. Therefore, when the feedstock M0 is defibrated (refined), the printed area PA becomes unrefined material, and the unprinted white area WA outside the printed area PA becomes the refined material. The refined material and undefibrated material can therefore be more effectively separated. As a result, color material CM in the printed part P can be effectively removed, and the whiteness of the resulting sheet S can be improved.

The configuration of parts of the sheet manufacturing apparatus 100 is described next.

The sheet manufacturing apparatus 100 shown in FIG. 1 and FIG. 2 has a first feedstock hopper 7, the sheet processing device 1 according to the invention, a second feedstock hopper 8, a feedstock supply device 11, a shredder 12, a defibrator 13, a classifier 14, a first web forming device 15, a cutter 16, a mixing device 17, a detangler 18, a second web forming device 19, a sheet forming device 20, a paper cutter 21, and a stacker 22. The sheet manufacturing apparatus 100 also has wetting unit 231, wetting unit 232, wetting unit 233, wetting unit 234, wetting unit 235, and wetting unit 236. Operation of parts of the sheet manufacturing apparatus 100 is controlled by a controller not shown.

As shown in FIG. 3, the sheet manufacturing method in this embodiment of the invention includes a printed area detection process, a refining prevention agent application process, a drying process, a feedstock supply process, a shredding process (refining process), a defibrating process (refining process), a classification process, a first web forming process, a cutting process, a mixing process, a detangling process, a second web forming process, a sheet forming process, and a sheet cutting process. Of these processes, the processes (sheet processing method) executed by the sheet processing device 1 are the printed area detection process, refining prevention agent application process, and drying process.

As shown in FIG. 1, the first feedstock hopper 7 is the part where feedstock M0 is stocked. The feedstock M0 in this example is fiber-containing material including fiber (particularly cellulosic fiber), and in this example is in a sheet form. In this embodiment, the feedstock M0 is recovered paper, that is, sheets that have been used, but the invention is not so limited and the feedstock M0 may be sheets that have not been used. In the case of unused sheets, printing ink, for example, is not removed, but soiling and foreign objects on the sheets can be removed.

Note that the cellulose fiber may be any fibrous material containing mainly cellulose (narrowly defined cellulose) as a chemical compound, and in addition to cellulose (narrowly defined cellulose) may include hemicellulose or lignin.

The sheet processing device 1 according to the invention is disposed on the downstream side of the first feedstock hopper 7. The sheet processing device 1 applies the process described below to the feedstock M0, producing feedstock M1, which is stored in the second feedstock hopper 8. A feedstock supply device 11 is disposed on the downstream side of the second feedstock hopper 8.

The feedstock supply device 11 is the part that executes the feedstock supply process (see FIG. 3) supplying feedstock M1 to the shredder 12.

The shredder 12 is the part that executes the shredding process (refining process) (see FIG. 3) of shredding, in air, the feedstock M1 supplied from the feedstock supply device 11. The shredder 12 has a pair of shredder blades 121 and a chute (hopper) 122.

By turning in opposite directions of rotation, the pair of shredder blades 121 shred the feedstock M1 passing therebetween, that is, cut the feedstock M1 into small shreds M2. The size and shape of the shreds M2 are preferably appropriate to the defibration process of the defibrator 13, and in this example are preferably pieces 100 mm or less on a side, and are further preferably pieces that are greater than or equal to 10 mm and less than or equal to 70 mm per side.

The chute 122 is located below the pair of shredder blades 121, and in this example is funnel-shaped. As a result, the chute 122 can easily catch the shreds M2 that are shredded and dropped by the shredder blades 121.

Above the chute 122, a wetting unit 231 is disposed beside the pair of shredder blades 121. The wetting unit 231 wets the shreds M2 in the chute 122. This wetting unit 231 has a filter (not shown in the figure) containing water, and is configured as a heaterless humidifier (or heated humidifier) that supplies a moist stream of air to the shreds M2 by passing air through the filter. By wet air being supplied to the shreds M2, shreds M2 sticking to the chute 122 due to static electricity can be suppressed.

The chute 122 connects to the defibrator 13 through a conduit (flow channel) 241. The shreds M2 collected in the chute 122 passes through the conduit 241 and are conveyed to the defibrator 13.

The defibrator 13 is the part that executes the defibrating process (refining process) (see FIG. 3) that defibrates the shreds M2 (fiber-containing material including fiber) in a dry process in air. Defibrated material M3 can be produced from the shreds M2 by the defibration process of the defibrator 13.

As used herein, defibrate means to break apart and detangle into single individual fibers shreds M2 composed of many fibers bonded together. The resulting detangled fibers are the defibrated material M3. The shape of the defibrated material M3 is strings and ribbons. The defibrated material M3 may also contain clumps, which are multiple fibers tangled together into clumps.

The defibrator 13 in this embodiment of the invention, for example, is configured as an impeller mill having a rotor that turns at high speed, and a liner disposed around the rotor. Shreds M2 introduced to the defibrator 13 are defibrated between the rotor and the liner.

The defibrator 13, by rotation of the rotor, produces an air flow (current) from the shredder 12 to the classifier 14. As a result, shreds M2 can be suctioned from the conduit 241 to the defibrator 13. In addition, after the defibration process, the defibrated material M3 can be fed through another conduit 242 to the classifier 14.

The defibrator 13 also functions to separate from the fibers materials such as resin particles bonded with the defibrated material M3 (shreds M2), ink, toner, and other color material CM, and bleeding inhibitors.

The defibrator 13 also connects through a conduit 242 (flow path) to the classifier 14. The defibrated material M3 (fiber-containing material after defibration) is conveyed through the conduit 242 to the classifier 14.

A blower 261 is disposed in the conduit 242. The blower 261 is an air flow generator that produces a flow of air to the classifier 14. This promotes conveyance of the defibrated material M3 to the classifier 14.

The classifier 14 (separator) is the part that classifies (separates) the defibrated material M3 into refined material (first screenings M4-1) and unrefined material (second screenings M4-2).

The classifier 14 includes a drum 141, and a housing 142 enclosing the drum 141.

The drum 141 functions as a sieve comprising a cylindrical mesh body that rotates on its center axis. By the drum 141 rotating, refined material (defibrated material) that is smaller than the mesh passes through and falls from the drum 141 as first screenings M4-1. The second screens M4-2 are discharged to the conduit (flow path) 243 connected to the drum 141. The end of the conduit 243 on the opposite end (downstream end) as the drum 141 is connected to another conduit 244. The second screenings M4-2 passing through the conduit 243 is conveyed toward the dust collector 27.

The first screenings M4-1 from the drum 141 are dispersed while dropping through air, and descend toward the first web forming device 15 (separator) below the drum 141. The first web forming device 15 is the part that executes a first web forming process (see FIG. 3) forming a first web M5 from the first screenings M4-1.

The first web forming device 15 includes a mesh belt (separation belt) 151, three tension rollers 152, and a suction unit (suction mechanism) 153.

The mesh belt 151 is an endless belt on which the first screened material M4-1 accumulates. This mesh belt 151 is mounted on three tension rollers 152. By rotationally driving the tension rollers 152, the first screened material M4-1 deposited on the mesh belt 151 is conveyed downstream.

The size of the first screened material M4-1 is greater than or equal to the size of the mesh in the mesh belt 151. As a result, passage of the first screened material M4-1 through the mesh belt 151 is limited, and as a result the first screened material M4-1 accumulates on the mesh belt 151.

Furthermore, because the first screened material M4-1 is conveyed downstream by the mesh belt 151 as the first screened material M4-1 accumulates on the mesh belt 151, the first screened material M4-1 is formed in a layer as a first web M5.

The first screenings M4-1 may contain impurities such as fillers added to the feedstock M0. These impurities are smaller than the mesh of the mesh belt 151. As a result, the impurities pass through the mesh belt 151 and precipitate.

The suction unit 153 suctions air from below the mesh belt 151. As a result, impurities that has past through the mesh belt 151 can be suctioned together with the air.

The suction unit 153 is connected to a dust collector 27 (collection device) through another conduit (flow path) 244. Impurities suctioned by the suction unit 153 are captured by the dust collector 27.

Another conduit (flow path) 245 is also connected to the dust collector 27. A blower 262 is disposed to the conduit 245. Operation of the blower 262 produces suction in the suction unit 153. This promotes formation of the first web M5 on the mesh belt 151. The first web M5 is made from material from which impurities have been removed. Operation of the blower 262 causes the impurities to pass through the conduit 244 and reach the dust collector 27.

The housing 142 is connected to a wetting unit 232. Like the wetting unit 231 described above, the wetting unit 232 is a heaterless humidifier. As a result, wet air is supplied into the housing 142. This wet air moistens the first screened material M4-1, and as a result can suppress sticking of the first screened material M4-1 to the inside walls of the housing 142 due to static electricity.

Another wetting unit 235 is disposed downstream from the classifier 14. This wetting unit 235 is configured as an ultrasonic humidifier that mists water. As a result, moisture can be supplied to (can humidify or moisten) the first web M5, and the moisture content of the first web M5 can thereby be adjusted. This adjustment can also suppress sticking of the first web M5 to the mesh belt 151 due to static electricity. As a result, the first web M5 easily separates from the mesh belt 151 at the tension roller 152 from where the mesh belt 151 returns to the upstream side.

On the downstream side of the wetting unit 235 is a cutter 16. The cutter 16 is a part that executes a cutting process (see FIG. 3) of cutting the first web M5 that has separated from the mesh belt 151.

The cutter 16 has a propeller 161 that is rotationally supported, and a housing 162 that houses the propeller 161. The first web M5 is cut into pieces by the first web M5 being fed into the rotating propeller 161. The cut first web M5 forms segments M6. The segments M6 then drop down in the housing 162.

The housing 162 is connected to another wetting unit 233. Like the wetting unit 231 described above, the wetting unit 233 is a heaterless humidifier. As a result, wet air is supplied into the housing 162. This wet air suppresses sticking of the segments M6 to the propeller 161 and to the inside walls of the housing 162 due to static electricity.

A mixing device 17 is disposed on the downstream side of the cutter 16. The mixing device 17 is the part that executes a mixing process (see FIG. 3) of mixing the segments M6 with resin P1. The mixing device 17 includes a resin supply device 171, a conduit (flow path) 172, and a blower 173.

The conduit 172 connects to the housing 162 of the cutter 16 and the housing 182 of the detangler 18, and is a flow path through which a mixture M7 of the segments M6 and resin P1 passes.

The resin supply device 171 connects to the conduit 172. The resin supply device 171 has a screw feeder 174. By rotationally driving the screw feeder 174, the resin P1 can be supplied in powder or particle form to the conduit 172. The resin P1 supplied to the conduit 172 is mixed with the segments M6, forming the mixture M7.

Note that the resin P1 bonds fibers together in a downstream process, and may be a thermoplastic resin or a thermosetting resin, but is preferably a thermoplastic resin. Examples of such thermoplastic resins include AS resin, ABS resin, polyethylene, polypropylene, ethylene-vinylacetate copolymer (EVA), or other polyolefin, denatured polyolefins, polymethylmethacrylate or other acrylic resin, polyvinyl chloride, polystyrene, polyethylene terephthalate, polybutylene terephthalate or other polyesters, nylon 6, nylon 46, nylon 66, nylon 610, nylon 612, nylon 11, nylon 12, nylon 6-12, nylon 6-66 or other polyimide (nylon), polyphenylene ether, polyacetal, polyether, polyphenylene oxide, polyether ether ketone, polycarbonate, polyphenylene sulfide, thermoplastic polyimide, polyether imide, aromatic polyester, or other liquid crystal polymer, styrenes, polyolefins, polyvinyl chlorides, polyurethanes, polyesters, polyimides, polybutadienes, transpolyisoprenes, fluoroelastomers, polyethylene chlorides and other thermoplastic elastomers, as well as combinations of one or two or more of the foregoing. Preferably, a polyester or resin containing a polyester is used as the thermoplastic resin.

Additives other than resin P1 may also be supplied from the resin supply device 171, including, for example, coloring agents for adding color to the fiber, anti-blocking agents for suppressing clumping of the fiber and clumping of the resin P1, and flame retardants for making the fiber and manufactured sheets difficult to burn. Starch and other vegetable materials may also be used.

The blower 173 is disposed to the conduit 172 downstream from the resin supply device 171. The blower 173 is configured to produce an air current toward the detangler 18. This air current can also mix the segments M6 and resin P1 inside the conduit 172. As a result, the mixture M7 can be introduced to the detangler 18 as a uniform dispersion of the segments M6 and resin P1. The segments M6 in the mixture M7 are further detangled into smaller fibers while travelling through the conduit 172.

The detangler 18 is the part that executes the detangling process (see FIG. 3) that detangles interlocked fibers in the mixture M7.

The detangler 18 includes a drum 181 and a housing 182 that houses the drum 181.

The drum 181 is a sieve comprising a cylindrical mesh body that rotates on its center axis. The mixture M7 is introduced to the drum 181. By the drum 181 rotating, fiber in the mixture M7 that is smaller than the mesh can pass through the drum 181. The mixture M7 is detangled in this process.

The mixture M7 that is detangled in the drum 181 is dispersed while dropping through air, and falls to the second web forming device 19 located below the drum 181. The second web forming device 19 is the part that executes the second web forming process (see FIG. 3) forming a second web M8 from the mixture M7. The second web forming device 19 includes a mesh belt 191 (separation belt), tension rollers 192, and a suction unit 193 (suction mechanism).

The mesh belt 191 is an endless belt on which the mixture M7 accumulates. This mesh belt 191 is mounted on four tension rollers 192. By rotationally driving the tension rollers 192, the mixture M7 deposited on the mesh belt 191 is conveyed downstream.

Most of the mixture M7 on the mesh belt 191 is larger than the mesh in the mesh belt 191. As a result, the mixture M7 is suppressed from passing through the mesh belt 191, and therefore accumulates on the mesh belt 191. The mixture M7 is conveyed downstream by the mesh belt 191 as the mixture M7 accumulates on the mesh belt 191, and is formed in a layer as the second web M8.

The suction unit 193 suctions air down from below the mesh belt 191. As a result, the mixture M7 can be pulled onto the mesh belt 191, and accumulation of the mixture M7 on the mesh belt 191 is thereby promoted.

Another conduit 246 (flow path) is connected to the suction unit 193. A blower 263 is also disposed to the conduit 246. Operation of the blower 263 produces suction in the suction unit 193.

Another wetting unit 234 is connected to the housing 182. Like the wetting unit 231 described above, the wetting unit 234 is a heaterless humidifier. As a result, wet air is supplied into the housing 182. By humidifying the inside of the housing 182 by adding wet air, sticking of the mixture M7 to the inside walls of the housing 182 due to static electricity can be suppressed.

Another wetting unit 236 is disposed below the detangler 18. This wetting unit 236 is configured as an ultrasonic humidifier similarly to the wetting unit 235 described above. As a result, moisture can be supplied to the second web M8, and the moisture content of the second web M8 can thereby be adjusted. This adjustment can also suppress sticking of the second web M8 to the mesh belt 191 due to static electricity. As a result, the second web M8 easily separates from the mesh belt 191 at the tension roller 192 from where the mesh belt 191 returns to the upstream side.

A sheet forming device 20 is disposed downstream from the second web forming device 19. The sheet forming device 20 is the part that executes the sheet forming process (see FIG. 3) forming sheets S from the second web M8. This sheet forming device 20 includes a calender 201 and a heater 202.

The calender 201 comprises a pair of calender rolls 203, and compresses the second web M8 between the calender rolls 203 without heating the second web M8. This process increases the density of the second web M8. The second web M8 is then conveyed toward the heater 202. Note that one of the pair of calender rolls 203 is a drive roller that is driven by operation of a motor (not shown in the figure), and the other is a driven roller.

The heater 202 has a pair of heat rollers 204, which can heat while compressing the second web M8 between the heat rollers 204. The combination of heat and pressure melts the resin P1 in the second web M8, and binds fibers through the molten resin P1. As a result, a sheet S is formed.

The sheet S is then conveyed to the paper cutter 21. Note that one of the pair of heat rollers 204 is a drive roller that is driven by operation of a motor (not shown in the figure), and the other is a driven roller.

A paper cutter 21 is disposed downstream from the sheet forming device 20. The paper cutter 21 is the part that executes the sheet cutting process (see FIG. 3) that cuts the continuous sheet S into single sheets S. The paper cutter 21 includes a first cutter 211 and a second cutter 212.

The first cutter 211 cuts the sheet S in the direction crosswise to the conveyance direction of the sheet S.

The second cutter 212 is downstream from the first cutter 211, and cuts the sheets S in the direction parallel to the conveyance direction of the sheet S.

Sheets S of a desired size are produced by the cutting action of the first cutter 211 and the second cutter 212. The sheets S are then conveyed further downstream and stacked in a stacker 22.

A sheet processing device 1 according to the invention is described next.

The sheet processing device 1 shown in FIG. 1 is disposed on the upstream side of the sheet manufacturing apparatus 100, and is a device that selectively applies a refining prevention agent D to the feedstock M0 described above.

The sheet processing device 1 has a conveyance unit 2, detector 3, refining prevention agent applicator 4, dryer 5, and controller 6, which are unitized in a housing not shown.

The sheet processing device 1 is an apparatus that sequentially executes a print detection process, refining prevention agent application process, and drying process.

Note that the sheet processing device 1 may be disposed or connected to the feedstock supply device 11 (see FIG. 2) through the second feedstock hopper 8. This enables processing sheets in the sheet process and manufacturing new sheets in the sheet recycling process in a single continuous operation.

Parts of the sheet processing device 1 are described next.

The conveyance unit 2 conveys the feedstock M0 downstream. The conveyance unit 2 includes a conveyor belt 210, tension roller 220, and tension roller 230, and the conveyor belt 210 is mounted around the tension rollers 220, 230. At least one of tension roller 220 and tension roller 230 has an internal motor, which drives and turns when turned on. As a result, the feedstock M0 on the conveyor belt 210 can be conveyed downstream (in the direction of the arrow in FIG. 1).

The surface of the conveyor belt 210 can preferably hold paper by means of adhesion or suction. This enables stable conveyance of the feedstock M0, and stable execution of the print detection process, refining prevention agent application process, and drying process described below. An example of a conveyor belt 210 that uses adhesion to hold the paper is a glue belt, and examples of belts that hold the paper by suction include suction belts and electrostatic belts.

Multiple feedstocks M0 can be deposited on the conveyor belt 210. The orientation (attitude) of the feedstock M0 on the conveyor belt 210 may be aligned or not.

Note that the conveyance unit 2 configuration shown in FIG. 1 is a belt conveyor, but the invention is not so limited and may be a configuration that conveys while holding the feedstock M0 by negative pressure suction on a stage, that is, a configuration that has a platen and multiple conveyance rollers.

The detector 3 is the part that executes the detection process for detecting the printed part P of the feedstock M0, and in this example has a camera 31 (imaging device) such as a CCD camera. The camera 31 is disposed separated from the conveyor belt 210 above the surface on one side of the conveyor belt 210, that is, the top side of the conveyor belt 210. The camera 31 images the feedstock M0 conveyed on the conveyor belt 210.

The camera 31 is electrically connected to the controller 6, and its operation is controlled by the controller 6. Image data captured by the camera 31 is sent to the controller 6.

Note that the detector 3 is a camera that captures a two-dimensional image in the configuration shown in FIG. 1, but the invention is not so limited, and may be a one-dimensional line sensor or scanner, for example. In this case, the detector 3 may be a reflective or transmissive detector.

The refining prevention agent applicator 4 is disposed above the conveyor belt 210 on the downstream side of the detector 3 and separated from the conveyor belt 210. As shown in FIG. 5, the refining prevention agent applicator 4 is the part that executes the refining prevention agent application process (see FIG. 3) selectively applying a refining prevention agent to the printed area PA (area).

In this example the feedstock M0 is recovered paper, that is, used paper that has been printed or written on. As a result, text, images, or other content has been printed on the feedstock M0 by applying black or color toner or ink, dyes, pigments, or other color material CM to the feedstock M0. Herein, the part of the feedstock M0 where color material CM is present is referred to as the printed part P. The printed part P is not limited to text, and may include symbols, graphics and images, or simply a soiled or smudged area.

The printed area PA containing the printed part P is a part of the feedstock M0 containing at least the printed part P and some surrounding white space (margin), and may be rectangular, square, round, oval, or other shape, but in the configuration shown in the figure is rectangular. Note that the printed area PA may not include white space. In addition, if the printed part P is a line (row) of text, the printed area PA may be the area containing that line (row or column).

The refining prevention agent applicator 4 may be a configuration including a discharge device (not shown in the figure) that applies the refining prevention agent D, and a storage tank (not shown in the figure) that stores the refining prevention agent D. The discharge device may be an inkjet printhead or a dot impact printhead, for example.

By being applied to the printed part P, the liquid L containing the refining prevention agent D coats the color material CM and fiber FB in the printed part P (see FIG. 6). As a result, excessive defibrating, that is, excessive refinement, of the color material CM and fiber FB in the defibrator 13 can be prevented.

"Refinement" as used herein includes both the shredding process of the shredder 12 and the defibration process of the defibrator 13, but in this embodiment refinement is described as the defibration process. Refinement as used in this embodiment therefore means passing the sheet material through a 1000 micron mesh sieve in a vibratory sieve shaker (AS200, Retsch) during continuous vibration for 10 minutes at a vibration amplitude of 1 mm or more.

The refining prevention agent applicator 4 preferably ejects the liquid L (which may be a solution, solid dispersion, emulsion, or other form) containing a refining prevention agent D to the printed area PA. As a result, the refining prevention agent D can be quickly and accurately applied to the printed part P, the refining prevention agent D can penetrate between the fibers FB, and the refining prevention agent D can more reliably cover the color material CM and fiber FB in the printed part P than a configuration that simply applies the refining prevention agent D with a coater.

The refining prevention agent D may be a hydrophobic material or a hydrophobic material.

Examples of hydrophilic materials include: polyvinyl alcohol, polyacrylamide (PAM), polymethacrylic acid resin, poly(acrylic acid) resin, starch, carboxymethyl cellulose, hydroxyethyl cellulose, methyl cellulose, hydroxypropyl cellulose, gelatin, pullulan, alginic acid, guar gum, locust bean gum, xanthan gum, pectin, carrageenan, polyamidine, polyethylene oxide, polyacrylamide, polyvinylacetamide, polydioxolane, polyvinylphenol, polyglycerin, (acryloyloxyethyl)trimethyl, ethyleneimine-based resin, polystyrene sulfonate resin, isoprene-based sulfonic acid resin, polyethylene glycol-based resin, polyvinylpyrrolidone-based resin, polymaleic acid-based resin, poly(itaconic acid)-based resin, 2-acrylamido-2-methylpropanesulfonic acid soda-based resin.

When the refining prevention agent D is hydrophilic and the fiber FB is cellulose, binding between the refining prevention agent D and fibers FB can be improved. As a result, refinement of the color material CM and fiber FB in the printed area PA can be more effectively prevented. In addition, water-based solvents and dispersion media can be used, and a liquid L containing a refining prevention agent D can be acquired at low cost.

Examples of hydrophobic materials include polyvinyl acetate-based resin, polyethylene-based resin, polypropylene-based resin, polystyrene-based resin, polyvinyl chloride-based resin, polyethylene terephthalate-based resin, nylon-based resin, polycarbonate-based resin, vinyl acetate-acrylic copolymer, Vinyl acetate ethylene copolymer, styrene acrylic copolymer, acrylic-urethane copolymer, vinyl chloride acrylic copolymer, and vinyl chloride ethylene copolymer.

By using a hydrophobic material, organic solvents can be used as a solvent, and the drying time can be shortened (drying rate can be increased). As a result, drying by the dryer 5 can be accelerated, and the processing rate (throughput) can be increased.

The dryer 5 is located downstream from the refining prevention agent applicator 4, and dries the liquid L containing the refining prevention agent D applied by the refining prevention agent applicator 4.

The dryer 5 has a pair of heat rollers 51 disposed facing the thickness direction of the conveyor belt 210, and compresses and heats the feedstock M0 passing between the heat rollers 51. This compression and heating process vaporizes the solvent or dispersion medium in the liquid L containing the refining prevention agent D applied to the printed part P. This also fixes the refining prevention agent D covering the color material CM and fiber FB in the printed part P (see FIG. 7). As a result, the printed part P can be prevented from breaking apart (refining) after the feedstock M1 passes the defibrator 13. In other words, the color material CM and fiber FB of the printed part P can be intentionally made to clump together.

Note that depending on the softening point of the refining prevention agent D, the refining prevention agent D can be made to soften in the dryer 5, coat the color material CM and fiber FB of the printed part P, and more strongly bind the color material CM and fiber FB of the printed part P.

In the configuration shown in the figure, the dryer 5 is configured to dry the feedstock M0 using the heat rollers 51, but the invention is not so limited and may be configured to dry by forced hot air.

Furthermore, if the refining prevention agent D comprises a quick-dry organic solvent, the fiber FB has high absorptivity to the refining prevention agent D, or the amount of refining prevention agent D applied is small, the feedstock M0 may dry quickly at room temperature and the dryer 5 may be omitted.

The feedstock M1 that has past through the sheet processing device 1 thus comprised is conveyed to the feedstock supply device 11 of the sheet manufacturing apparatus 100 shown in FIG. 2, and therefrom to the downstream side of the sheet manufacturing apparatus 100. As described above, the feedstock M1 passes from the feedstock supply device 11 to the shredder 12, defibrator 13, classifier 14, first web forming device 15, cutter 16, mixing device 17, detangler 18, second web forming device 19, and sheet forming device 20, becoming a sheet S.

In the feedstock M1 (shreds M2) supplied to the defibrator 13, the color material CM and fiber FB of the printed part P (printed area PA) are covered and bonded together by the refining prevention agent D (see FIG. 7). As a result, the fiber FB in the white area WA outside the printed part P is defibrated in the defibrator 13 and becomes refined feedstock, but the color material CM and fiber FB of the printed part P is not refined and becomes unrefined waste. More specifically, because of the refining prevention agent D, the defibrated material M3 contains both refined feedstock and unrefined waste material. As a result, the classifier 14 can more effectively separate the desired refined feedstock from the unrefined waste material. This enables effectively removing the color material CM in the printed part P, and further improving the whiteness of the resulting sheet S.

As shown in FIG. 4, the controller 6 has a CPU 61 (processor) and storage 62 (memory or hard disk drive, for example), and controls operation of the conveyance unit 2, detector 3, refining prevention agent applicator 4, and dryer 5. The controller 6 in this embodiment may be disposed where desired in the sheet processing device 1, or it may be an externally connected control device. In configured as an external device, the control device and sheet manufacturing apparatus may communicate wirelessly or by wire, or through the Internet, for example. In addition, a configuration in which only the CPU 61 or the storage 62 is an external device is also conceivable.

Note that there may also be multiple dedicated controllers for the conveyance unit 2, detector 3, refining prevention agent applicator 4, and dryer 5.

In this embodiment, the controller 6 is dedicated to the sheet processing device 1, and separate controllers are provided for the shredder 12 to sheet forming device 20, but the invention is not so limited. For example, the controllers of devices from the shredder 12 to the sheet forming device 20 may also be configured to control other parts of the sheet processing device 1, and the controller 6 may control devices from the shredder 12 to the sheet forming device 20 in addition to controlling parts of the sheet processing device 1.

The CPU 61 executes programs stored in storage 62. The CPU 61 functions as a data processor that processes image data captured by the camera 31. As described above, the CPU 61 also identifies the printed part P and defines the printed area PA.

The detector 3 has a camera 31 (imaging unit) that images the feedstock M0 (sheet), and the controller 6 has a CPU 61 that functions as a data processor that processes image data captured by the camera 31 (imaging unit). This enables identifying the printed part P and defining the printed area PA.

The storage 62 in this example is rewritable nonvolatile memory. Programs such as programs related to sheet processing as described above are stored in storage 62, and the programs are run by the CPU 61.

The control operation of the controller 6 is described next with reference to the flow chart in FIG. 8.

Sheet processing starts in step S101. In other words, the conveyance unit 2 and dryer 5 are operated.

Next, the supplied and conveyed feedstock M0 is imaged (step S102). Note that when the feedstock M0 is supplied by a feeding device not shown, the timing of detector 3 (camera 31) operation, that is, imaging, may be adjusted to the conveyance speed of the conveyance unit 2, or the timing of imaging may be adjusted by a timer based on calculating the time required for the feedstock M0 to be conveyed to the imaging area.

Next, in step S103, the printed part P is detected in the image acquired in step S102 (print detection process). For example, the image may be divided into specific areas, and when the brightness in each area is less than a specific threshold, the controller 6 may decide color material CM was detected, but if the brightness is greater than or equal to the specific threshold, decide there is no color material CM. The printed part P can be determined based on this information.

Next, in step S104, the controller 6 defines the printed area PA containing the printed part P identified in step S103 (see FIG. 5).

Next, in step S105, the controller 6 applies the refining prevention agent D to the printed area PA set in step S104 (refining prevention agent application process). If the refining prevention agent applicator 4 has multiple nozzles, the refining prevention agent D is applied by selectively driving the nozzles to discharge (eject) refining prevention agent D based on the position of the printed area PA in the image. This enables selectively applying the refining prevention agent D to the printed area PA.

The feedstock M0 to which refining prevention agent D was applied passes through the dryer 5 (drying process), and as described above becomes feedstock M1 in which refinement of the printed area PA is prevented. This feedstock M1 is then discharged from the sheet processing device 1 and supplied to the feedstock supply device 11.

The sheet processing device 1 thus has a controller 6 that controls operation of the refining prevention agent applicator 4 based on information detected by the detector 3. As a result, refining prevention agent D can be selectively applied to the printed area PA including the printed part P detected by the detector 3. As a result, the defibrator 13 can produce both refined feedstock and unrefined waste material, and color material CM can be more effectively removed.

The sheet processing device 1 has a conveyance unit 2 that conveys the feedstock M0 (sheet), and does at least one of (in this embodiment, does both) detecting the printed part P of feedstock M0 (sheets) conveyed by the conveyance unit 2, and applying refining prevention agent D to the printed area PA of the feedstock M0 (sheet) conveyed by the conveyance unit 2. As a result, the printed part P can be detected during conveyance of the feedstock M0, and refining prevention agent D can be applied during conveyance of the feedstock M0. In other words, pausing conveyance to detect the printed part P, and pausing conveyance to apply refining prevention agent D to the printed area PA, can be prevented. As a result, a drop in processing efficiency (productivity) can be prevented.

Embodiment 2

Figure 9:
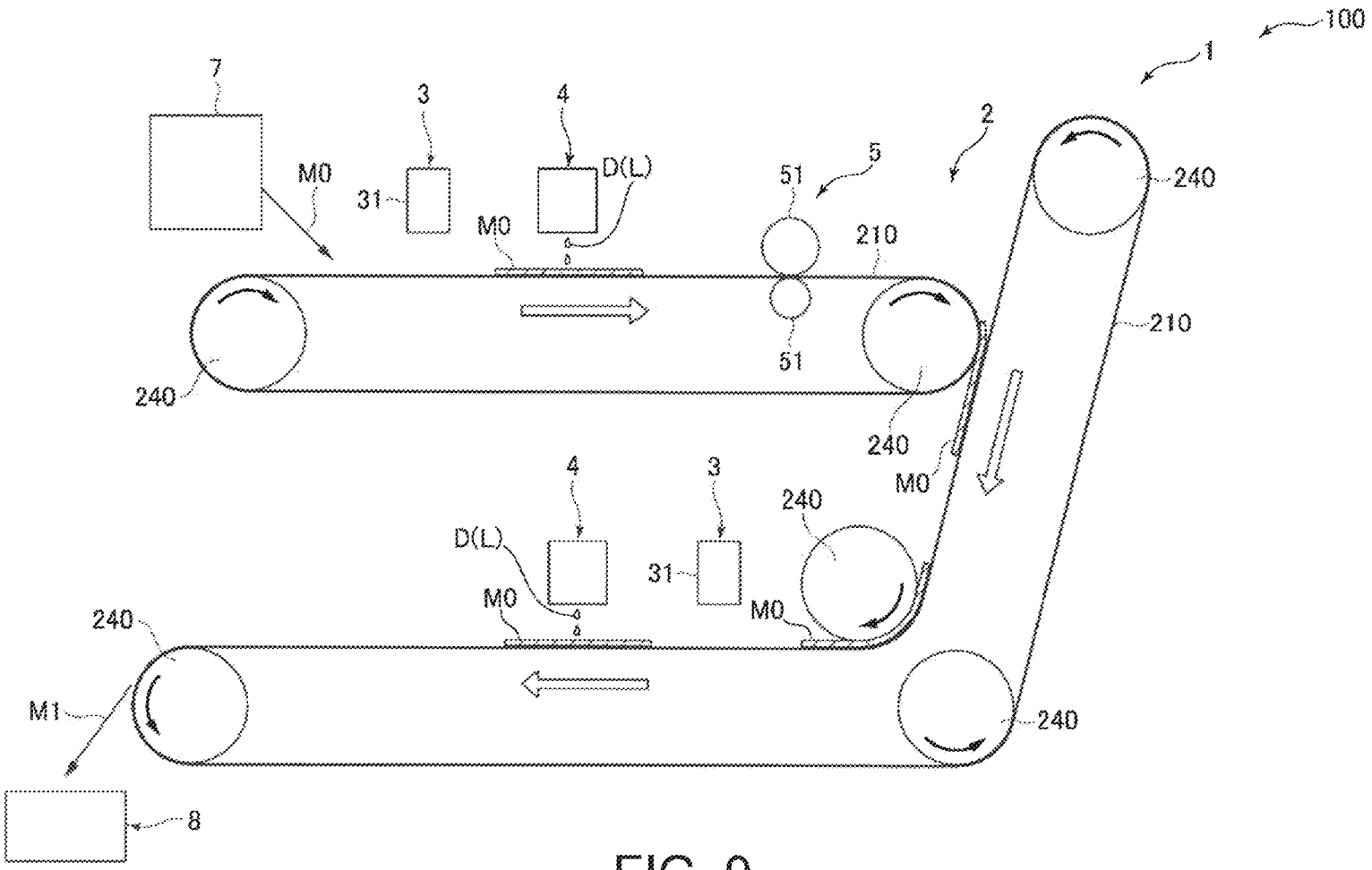
FIG. 9 is a schematic side view illustrating the configuration of a sheet processing device according to the invention on the upstream side of a sheet manufacturing apparatus according to a second embodiment of the invention.

FIG. 9 is a schematic side view illustrating the configuration of the upstream side (the sheet processing device according to the invention) of a sheet manufacturing apparatus according to a second embodiment of the invention.

A second embodiment of a sheet manufacturing apparatus according to the invention is described below with reference to the accompanying figures, focusing on the differences between this and the foregoing embodiment, and omitting or simplifying further description of like elements.

This embodiment is the same as the configuration of the first embodiment except for the number of detectors, refining prevention agent applicators, and dryers.

As shown in FIG. 9, the conveyance unit 2 of the sheet processing device 1 according to this embodiment has another conveyor belt 210 on the downstream side of the conveyor belt 210 described in the first embodiment.

This conveyor belt 210 is an endless belt that travels around three tension rollers 240. Of the three tension rollers 250, the middle tension roller 240 is offset from a line between the other two tension rollers 250. In this configuration, the conveyor belt 210 is pushed against the middle tension roller 250 by a pressure roller 240. As a result, the conveyor belt 210 follows a curved path.

One detector 3, refining prevention agent applicator 4, and dryer 5 (not shown in the figure) are also disposed on the downstream side of the pressure roller 240.

The feedstock M0 is processed by first applying the refining prevention agent D to the top side (front side) of the feedstock M0 when carried on the upstream (first) conveyor belt 210, and is then passed to and conveyed by the downstream (second) conveyor belt 210. When transferred to the second conveyor belt 210, the feedstock M0 is reversed so that the opposite side (back side) as the side that was processed on the first conveyor belt 210 is exposed to the top for processing. The feedstock M0 then passes between the pressure roller 240 and conveyor belt 210, and the surface on the opposite side (back side) as the side (front side) that was processed on the first conveyor belt 210 is processed.

This configuration enables applying the invention to both sides of the feedstock M0 in a single pass when there is a printed part P on both sides of the feedstock M0, that is, when the feedstock M0 was printed on both sides.

This embodiment describes a configuration having one detector 3, refining prevention agent applicator 4, and dryer 5 disposed to both conveyor belt 210 and conveyor belt 240, but these may be disposed to the conveyor belt 210 side. In this case, the detectors 3 are preferably disposed in opposition with the conveyor belt 210 therebetween. If detectors 3 are disposed in opposition with the conveyor belt 210 therebetween, the conveyor belt 210 is changed to a conveyor belt that holds the feedstock M0 by adhesion or suction in part to the top, or a belt that allows light to pass through (such as a mesh belt or transparent belt).

Embodiment 3

Figure 10:
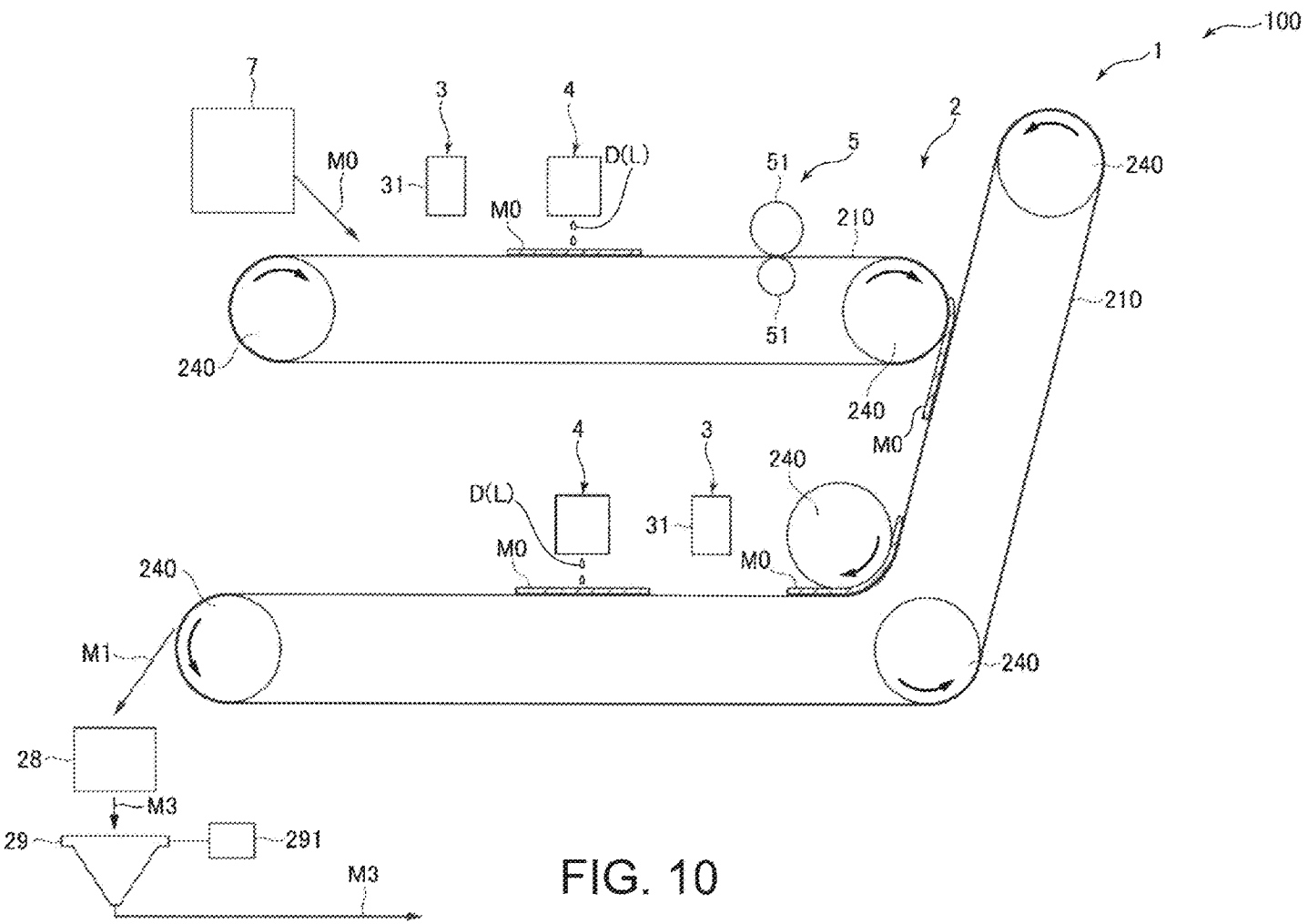
FIG. 10 is a schematic side view illustrating the configuration of a sheet processing device according to the invention on the upstream side of a sheet manufacturing apparatus according to a third embodiment of the invention.

FIG. 10 is a schematic side view illustrating the configuration of the upstream side (the sheet processing device according to the invention) of a sheet manufacturing apparatus according to a third embodiment of the invention.

A third embodiment of a sheet manufacturing apparatus according to the invention is described below with reference to the accompanying figures, focusing on the differences between this and the foregoing embodiment, and omitting or simplifying further description of like elements.

This embodiment is the same as the configuration of the second embodiment except for a refining device and classifier.

As shown in FIG. 10, the sheet processing device 1 according to this embodiment also has a defibrator 28 disposed on the downstream side of the second conveyor belt 210, and a classifier 29 disposed on the downstream side of the defibrator 28.

The defibrator 28 is the part that executes the defibrating process (refining process) that defibrates the feedstock M1 (fiber-containing material including fiber) in air, that is, in a dry process. The defibrator 28 in this example is configured as an impeller mill having a rotor that turns at high speed, and a liner disposed around the rotor. Feedstock M1 introduced to the defibrator 28 are defibrated between the rotor and the liner.

The classifier 29 in this embodiment is a so-called cyclonic separator, is configured with a conical housing with a supply inlet to which the defibrated material M3 is supplied and a discharge outlet, and an air current generator that produces a circular air flow inside the housing. The supplied defibrated material M3 is separated in the classifier 29 by differences in specific gravity into refined material and unrefined waste material, and the refined material is supplied to the downstream side of the sheet manufacturing apparatus 100. Note that the unrefined waste material is recovered by a dust collector 291.

The sheet processing device 1 according to this embodiment thus has a defibrator 28 as a refining device that refines feedstock M1 (sheets) with refining prevention agent D applied to the printed parts P thereof, and the refining prevention agent D applied to the printed part P suppresses refinement (defibration) of the printed area PA compared with the unprinted white areas WA (areas) outside the printed area PA in the defibrator 28 (refining device).

In other words, this embodiment also executes a defibration (refining) process for defibrating the feedstock M1 (sheet) after the refining prevention agent application process, and in this refining process, suppresses refinement of the printed area PA compared with refinement of the unprinted white areas WA (areas) outside the printed area PA. As a result, the defibrator 28 produces refined material and unrefined waste material.

More specifically, refined material and unrefined waste material can be produced in the sheet processing device 1, and the defibrator 13 disposed in the first embodiment to the sheet manufacturing apparatus 100 downstream from the sheet processing device 1 can therefore be omitted.

The sheet processing device 1 according to this embodiment also has a classifier 29 for classifying the refined material produced by the defibrator 28 (refining device). In other words, the refining process is followed by a classification process that classifies the refined material acquired by the refining process. The classification process separates the refined material from the unrefined waste material.

More specifically, refined material and unrefined waste material can be classified (separated or selected) in the sheet processing device 1, and the classifier 14 disposed in the first embodiment to the sheet manufacturing apparatus 100 downstream from the sheet processing device 1 can therefore be omitted.

Embodiment 4

Figure 11:
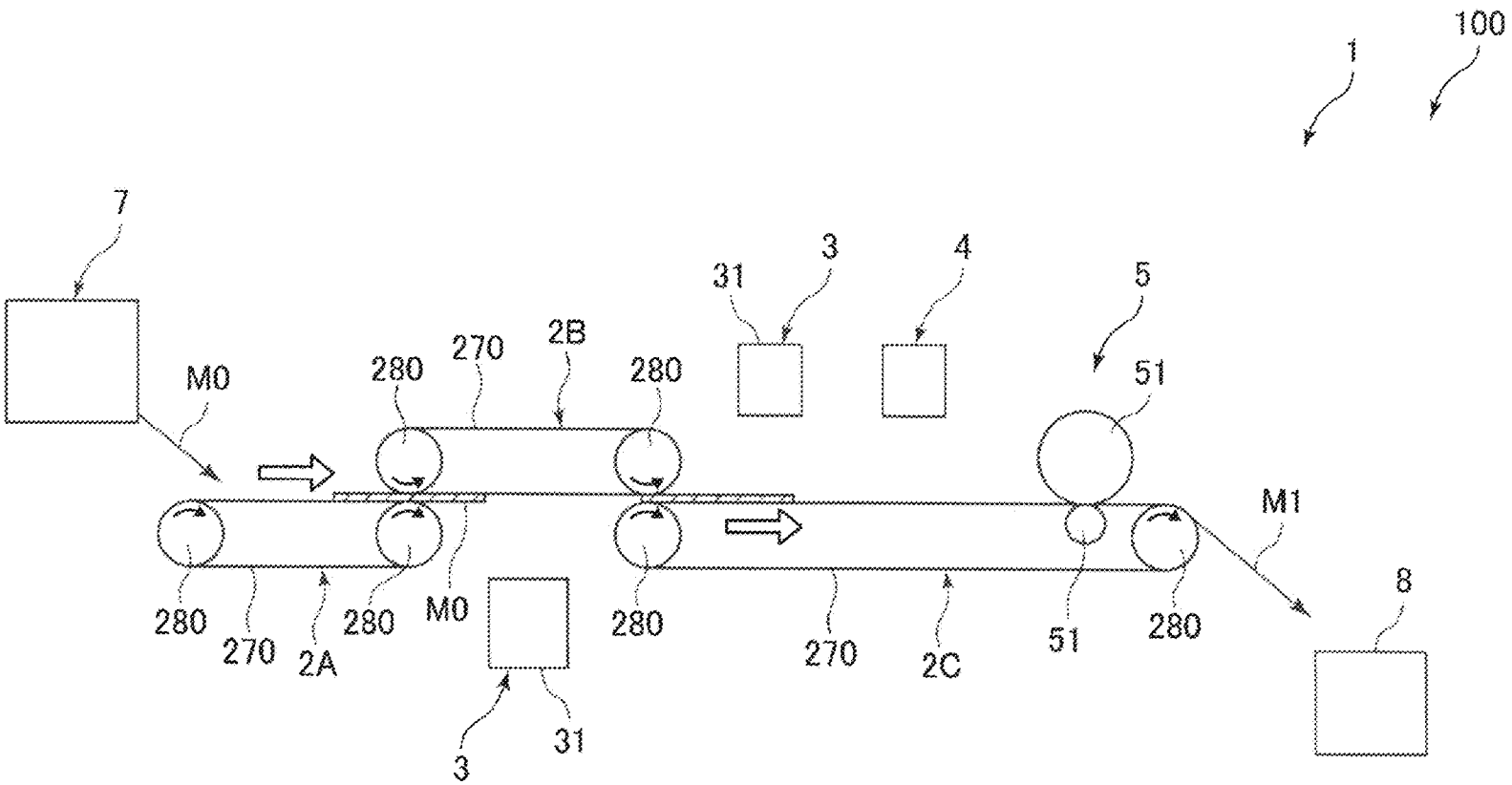
FIG. 11 is a schematic side view illustrating the configuration of a sheet processing device according to the invention on the upstream side of a sheet manufacturing apparatus according to a fourth embodiment of the invention.

FIG. 11 is a schematic side view illustrating the configuration of the upstream side (a sheet processing device according to the invention) of a sheet manufacturing apparatus according to a fourth embodiment of the invention.

A fourth embodiment of a sheet manufacturing apparatus according to the invention is described below with reference to the accompanying figures, focusing on the differences between this and the foregoing embodiment, and omitting or simplifying further description of like elements.

This embodiment is the same as the configuration of the second embodiment except for the configuration of the conveyance unit and the locations of the detector and refining prevention agent applicator.

As shown in FIG. 11, the conveyance unit 2 in this embodiment has three conveyor belt units 2A, 2B, 2C. Each of the belt units 2A, 2B, 2C has a conveyor belt 270, and a pair of tension rollers 280 around which the conveyor belt 270 travels.

The belt units 2A, 2B, 2C are disposed in this order from the upstream side. Belt unit 2A and belt unit 2C are disposed at the same height, and belt unit 2B is disposed above belt units 2A, 2C.

Belt unit 2A and belt unit 2B are disposed so that tension rollers 280 thereof are superimposed with each other in a plan view of the conveyor belt 270, and belt unit 2B and belt unit 2C are disposed so that tension rollers 280 thereof are superimposed with each other in a plan view of the conveyor belt 270, as shown in FIG. 11.

The detector 3 is disposed below belt unit 2B in this configuration. Another detector 3, and the refining prevention agent applicator 4 and dryer 5, are disposed above the belt unit 2C.

The feedstock M0 supplied from the first feedstock hopper 7 is first conveyed by the conveyor belt 270 of belt unit 2A. The feedstock M0 is conveyed by the conveyor belt 270 of belt unit 2B as the feedstock M0 passes between belt unit 2A and belt unit 2B. The feedstock M0 is then conveyed by the conveyor belt 270 of belt unit 2C while passing between belt unit 2B and belt unit 2C.

The printed part P on the bottom (back side) of the feedstock M0 is detected while the feedstock M0 is conveyed by the conveyor belt 270 of belt unit 2B. The printed part P on the top (front side) of the feedstock M0 is detected while the feedstock M0 is conveyed by the conveyor belt 270 of belt unit 2C. As a result, the printed parts P on both sides of the feedstock M0 can be imaged.

The printed area PA is then defined on one side to include the printed parts P on both sides, and a refining prevention agent is applied to the printed area PA. Note that in this embodiment the refining prevention agent is applied to penetrate completely through the thickness of the feedstock M0. This enables processing the printed parts P on both sides while applying the refining prevention agent from only one side. To ensure the refining prevention agent completely permeates the thickness of the feedstock M0, the amount of refining prevention agent the refining prevention agent applicator 4 applies can be adjusted, or the viscosity or surface tension of the refining prevention agent can be adjusted, for example.

A sheet manufacturing apparatus according to the invention is described above with reference to accompanying figures, but the invention is not so limited. In addition, parts of the sheet manufacturing apparatus can be replaced with other configurations having the same function. Other desirable configurations can also be added.

The sheet manufacturing apparatus according to the invention may also be a combination of two or more desirable configurations (features) of the embodiments described above.

The foregoing embodiments are described with the refining device being the defibrator, but the invention is not so limited. The refining device may be the shredders, for example. More specifically, the refined material may be coarse shreds. In addition, both the shredder and defibrator may function as refining devices.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-191455, filed Sep. 29, 2017 is expressly incorporated by reference herein.

What is claimed is:

1. A sheet processing device that processes a printed sheet, comprising:

a detector configured to detect a printed part printed on the sheet; and a refining prevention agent applicator configured to selectively apply a refining prevention agent that prevents refinement of the sheet to a printed area including the printed part detected by the detector.

2. The sheet processing device described in claim 1, further comprising:

a conveyance unit configured to convey the sheet;

the sheet processing device executing at least one of detecting the printed part of the sheet conveyed by the conveyance device, and applying the refining prevention agent to the printed area of the sheet conveyed by the conveyance device.

3. The sheet processing device described in claim 1, wherein:

the refining prevention agent applicator ejects a liquid containing the refining prevention agent to the printed area.

4. The sheet processing device described in claim 1, wherein:

the refining prevention agent is hydrophilic.

5. The sheet processing device described in claim 1, further comprising:

a refining device configured to refine the sheet with the refining prevention agent applied to the printed part, refinement of the printed area by the refining device being suppressed compared with refinement of areas outside the printed area.

6. The sheet processing device described in claim 5, further comprising:

a classifier configured to classify refined material acquired by the refining device.

7. The sheet processing device described in claim 1, further comprising:

a controller configured to control operation of the refining prevention agent applicator based on information detected by the detector.

8. The sheet processing device described in claim 1, wherein:

the detector has an imaging device configured to image the sheet; and the controller has a data processor configured to process image data acquired by the imaging device.

9. A sheet manufacturing apparatus comprising a sheet processing device according to claim 1.

10. A sheet processing method of processing a sheet supplied as feedstock of recycled sheets, comprising:

a detection process of detecting a printed part printed on the sheet; and a refining prevention agent application process of selectively applying a refining prevention agent that prevents refinement of the sheet to a printed area including the printed part detected by the detection process.

11. The sheet processing method described in claim 10, further comprising:

a refining process of refining the sheet after the refining prevention agent application process, refinement of the printed area by the refining process being suppressed compared with refining areas outside the printed area.

12. The sheet processing method described in claim 11, further comprising:

a classifying process that executes after the after the refining process and classifies refined material acquired by the refining process.

* * * * *